US007581286B2

(12) United States Patent
Choi

(10) Patent No.: US 7,581,286 B2
(45) Date of Patent: Sep. 1, 2009

(54) VACUUM CLEANER AND DUST COLLECTION UNIT THEREOF

(75) Inventor: Jong Seong Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 620 days.

(21) Appl. No.: 11/100,536

(22) Filed: Apr. 7, 2005

(65) Prior Publication Data

US 2006/0117520 A1 Jun. 8, 2006

(30) Foreign Application Priority Data

Dec. 8, 2004 (KR) ..... 20-2004-0034814 U

(51) Int. Cl.
*A47L 9/10* (2006.01)
*A47L 9/16* (2006.01)

(52) U.S. Cl. ..... 15/352; 15/347; 15/353

(58) Field of Classification Search ..... 15/352, 15/353, 347, 337, 523, 528, 379, 328, 323
See application file for complete search history.

(56) References Cited

U.S. PATENT DOCUMENTS

| | | | | |
|---|---|---|---|---|
| 6,003,196 | A * | 12/1999 | Wright et al. | 15/353 |
| 6,375,696 | B2 * | 4/2002 | Wegelin et al. | 55/337 |
| 6,502,278 | B2 * | 1/2003 | Oh et al. | 15/353 |
| 6,532,620 | B2 * | 3/2003 | Oh | 15/353 |
| 2003/0024069 | A1 * | 2/2003 | Bair et al. | 15/352 |

* cited by examiner

*Primary Examiner*—Randall Chin
(74) *Attorney, Agent, or Firm*—Ked & Associates, LLP

(57) ABSTRACT

Provided is a dust collection unit of a vacuum cleaner having a handle formed on an outer circumference of the dust collection container and having an opened bottom such that user's fingers are inserted upward from a lower side of the handle for more convenient use of the vacuum cleaner.

18 Claims, 6 Drawing Sheets

VACUUM CLEANER AND DUST COLLECTION UNIT THEREOF

BACKGROUND OF THE INVENTION

1. Field of the Invention

The present invention relates to a vacuum cleaner, and particularly to a dust collection unit of a vacuum cleaner allowing a user to handle it conveniently. Further, the invention relates to a dust collection unit of a vacuum cleaner allowing a user to separate, install and clean it conveniently.

2. Description of the Related Art

A vacuum cleaner is generally classified into a canister vacuum cleaner and an upright vacuum cleaner. Particularly, the upright vacuum cleaner includes a main body, a nozzle unit and a handle that are integrally formed, so the vacuum cleaner itself is moved when a user pushes or pulls a handle with gripping it. At this time, dusts on the floor are sucked through the nozzle to clean the floor. A general configuration of such an upright vacuum cleaner is already well known from many documents, so its detail description is omitted.

Meanwhile, a dust collection unit is detachably installed in the main body of the vacuum cleaner. When the vacuum cleaner operates, the dust collection unit is installed in the main body of the vacuum cleaner. When a predetermined amount of dirt is accumulated in the dust collection unit, the dust collection unit is separated from the main body such that captured dirt is discharged. Inside the dust collection unit, a cyclone member capturing dirt using a cyclone way and a filtering member separating dirt using a filtering way can be formed respectively. The filtering member is generally fixed to a lower surface of an upper cover of the dust collection unit.

Meanwhile, in order for a user to separate the dust collection unit from the main body, a dust collection box handle extending in a vertical direction is generally formed at a side surface of a dust collection box. To operate the dust collection box handle, a user holds the dust collection box handle using one hand and operates a hanging structure using the other hand. Also, in order to separate the upper cover of the dust collection unit, the user holds and lifts up a corner of the upper cover.

However, to pull out the dust collection unit holding the dust collection box handle, it is disadvantageous that a user has to hold the dust collection box handle using one hand and to operate a hanging structure using the other hand. Also, since the dust collection box handle is formed in a vertical direction, it is disadvantageous that the user has to hold the dust collection box hand with the user's body down.

Further, when the user pulls up the upper cover with holding a cover handle formed at a predetermined portion of the upper cover using one hand, the cover is pulled out with leaning toward one direction and therefore dirt attached to the filtering member may be detached therefrom. Of course, the detached dirt causes a user to feel displeasure. Furthermore, since the whole of the cover is not pulled out exactly upward, it is disadvantageous that the upper cover and the dust collection box are interfered with each other and are not easily pulled out.

SUMMARY OF THE INVENTION

Accordingly, the present invention is directed to a vacuum cleaner and a dust collection unit thereof that substantially obviate one or more problems due to limitations and disadvantages of the related art.

An object of the invention is to provide a vacuum cleaner and a dust collection unit thereof that allow a user to handle it conveniently.

Another object of the invention is to provide a vacuum cleaner and a dust collection unit thereof that allow a user to conveniently separate or install it from/at a body of the vacuum cleaner with holding the dust collection unit.

A further object of the invention is to provide a vacuum cleaner and a dust collection unit thereof that allow a user to more conveniently separate an upper cover of the dust collection unit.

Further another object of the invention is to provide a vacuum cleaner and a dust collection unit thereof having a more improved appearance by getting rid of portions protruded outward from the dust collection unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a vacuum cleaner comprising: a nozzle unit for sucking outer air; a body into which the air sucked through the nozzle unit is introduced; a motor received in the nozzle unit or the body; a suction fan for sucking air using a rotational force of the motor; and a dust collection unit detachably installed in the body, for filtering foreign particles contained in the introduced air, wherein the dust collection unit comprises a cylindrical dust collection container and a handle protruded from a predetermined portion of an outer circumferential surface of the dust collection container and having an opened bottom. Alternatively, the vacuum cleaner further comprises a detachable lever formed at an upper side portion of the body adjacent to the dust collection unit and manipulated by a user.

Another aspect of the present invention, there is provided a dust collection unit of a vacuum cleaner, comprising: a dust collection container for collecting foreign particles therein, and having a handle formed on an outer circumference thereof, the handle having an opened bottom through which a user's hand is inserted; an upper cover for selectively opening and closing an upper surface of the dust collection container; and a pair of finger grooves concaved from an upper surface of the upper cover such that a user holds the upper cover when the upper cover is separated from the dust collection container.

Another aspect of the present invention, there is provided a vacuum cleaner comprising: a nozzle unit for sucking outer air; a body into which the air sucked through the nozzle unit is introduced, the body receiving at least a motor and a suction fan therein; a manipulation handle formed at an upper portion of the body and allowing a user to manipulate the body; a connection hose connecting the nozzle unit with the body; a dust collection unit detachably installed in the body, for filtering foreign particles contained in the introduced air; a detachable lever formed at an upper side portion of the body adjacent to the dust collection unit and manipulated when the dust collection container is separated or installed; a handle formed on an outer circumference of the dust collection container and having an opened bottom such that user's fingers are inserted; and an upper cover for selectively opening and closing an upper surface of the dust collection container.

According to the present invention, a user can handle the dust collection unit more conveniently from the body. Also, the separation operation of dirt from the dust collection unit can be made simple and convenient. In addition, since the dirt captured on the filter is not detached while the foreign particles are discarded, it is possible to use the dust collection unit more delightfully.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
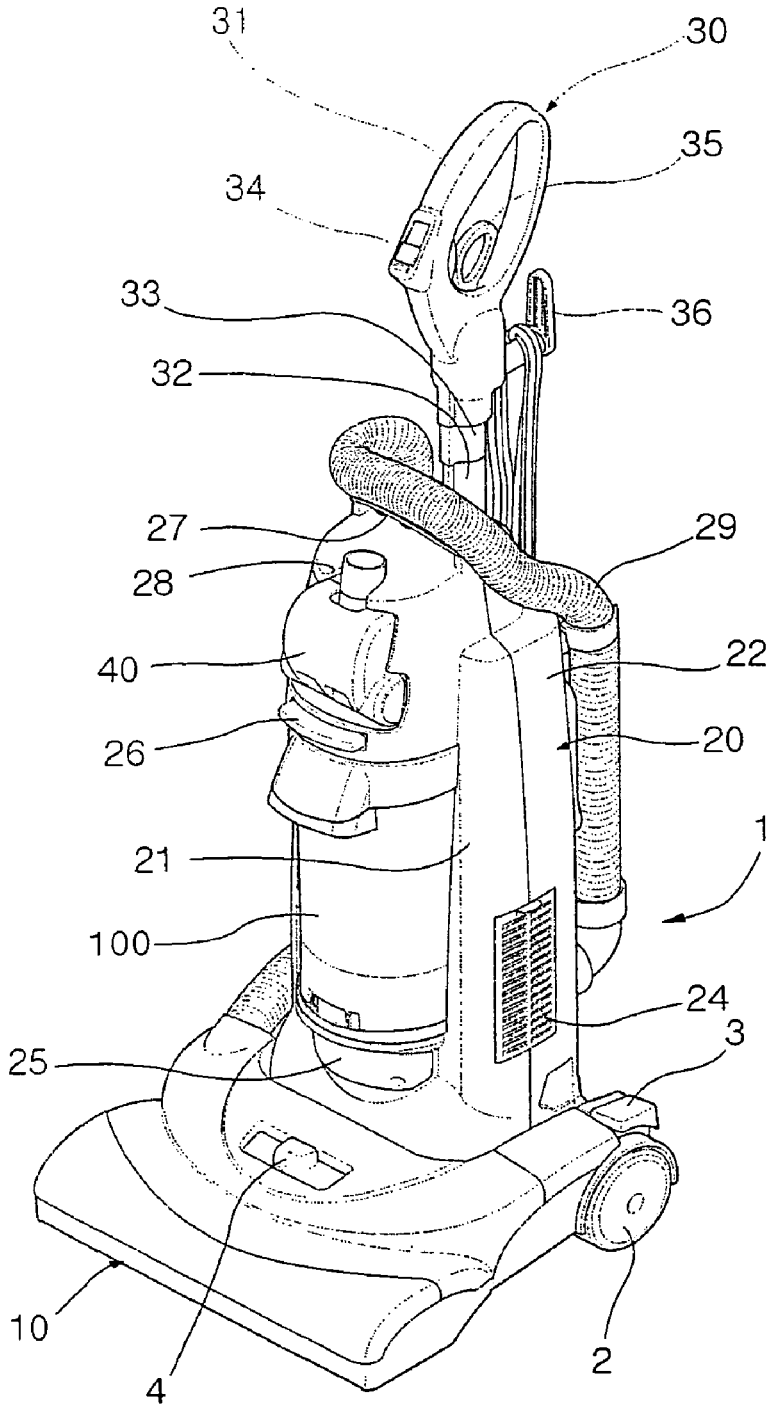
FIG. 1 is a front perspective view of an upright vacuum cleaner according to the present invention.
Figure 2:
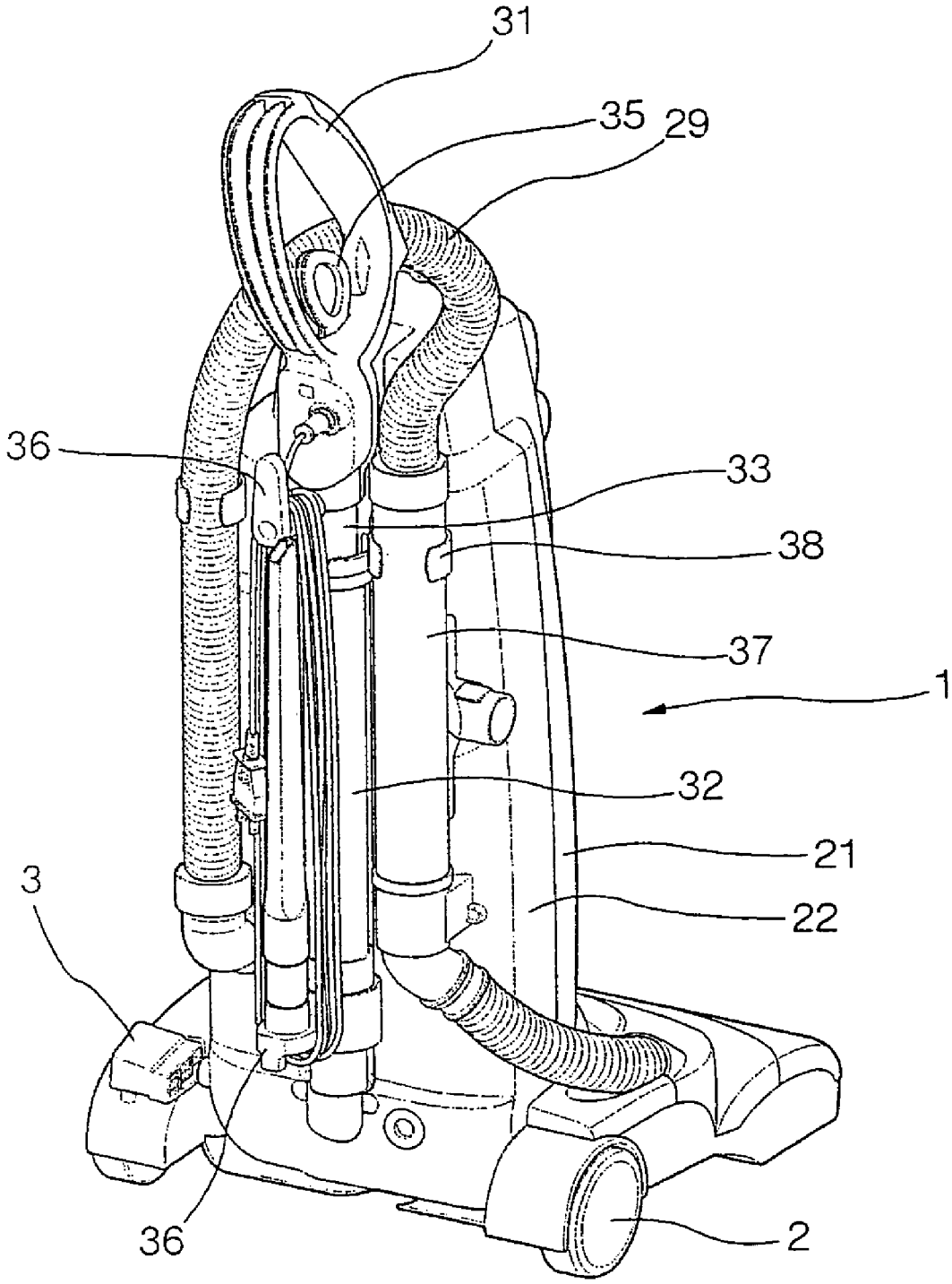
FIG. 2 is a rear perspective view of an upright vacuum cleaner according to the present invention.

FIG. 1 is a front perspective view of an upright vacuum cleaner according to the present invention, and FIG. 2 is a rear perspective view of the upright vacuum.

Referring to FIGS. 1 and 2, the upright vacuum cleaner 1 macroscopically includes a suction nozzle unit 10 contacts with a floor to suck outer air, a body 20 in which main parts including a suction motor and a fan are mounted, and a manipulation handle 30 formed on an upper portion of the vacuum cleaner such that the vacuum cleaner is moved in an easy way during the cleaning work. The cleaning work using the vacuum cleaner is conducted as follows. First, air is sucked through the suction nozzle unit 10 together with foreign particles. The foreign particles are separated from the sucked air while passing through the body 20 and cleaned, and then the cleaned air is exhausted through a predetermined discharge hole. In addition, in order to move the vacuum cleaner to a desired position, a user grips the manipulation handle 30 of the vacuum cleaner and then pulls or pushes the vacuum cleaner 1.

In detail, the suction nozzle unit 10 is used for sucking outer air and has a substantially rectangular shape with an opening opened toward the floor. The suction nozzle unit 10 is hinged to the body 20, and a pivoting lever 3 controls this hinge movement. In addition, for better movement of the suction nozzle unit 10, the suction nozzle unit f10 further includes wheels 2 installed at a rear portion of the suction nozzle unit 10, and a height control knob 4 installed on an upper surface of the suction nozzle unit 10 for height control of the suction nozzle unit 10. The air sucked into the suction nozzle unit 10 is guided to the body 10 by means of a hose 29. For this purpose, both ends of the hose 29 are connected to the suction nozzle unit 10 and the body 20, respectively.

In detail, the body 20 includes a front case 21 for protecting a front portion of the body 20 and a rear case 22 for protecting a rear portion of the body 20, and the front and rear portions are fixed with each other by a certain manner such as fitting or screwing. Furthermore, the body 20 is provided with a dust collecting unit 100 for collecting dusts from the air sucked through the hose 29, a detachable lever 26 for separating the dust collecting unit 100 from the body 20 in a convenient way, a discharge cover 24 formed in a side of the body 20 for allowing the air free from foreign particles to be discharged, a lamp 25 for lighting the floor at night so that the vacuum cleaner may be manipulated in a convenient way, a mini nozzle seat 28 concaved in the top of the front case 21, and a mini nozzle 40 selectively received in the mini nozzle seat 28. The mini nozzle 40 may be used for cleaning places that are not directly contacted with the main body of the upright cleaner like a corner and received in the mini nozzle seat 28 during a custody time. Inside the dust collection unit 100, a cyclone type dust collection member capturing foreign particles using a cyclone way and a filtering type dust collection member separating foreign particles using a filtering way can be formed respectively. The two dust collection members are disposed inside the body 20.

In addition, the body 20 is also provided on its rear side with a code hook 36 protruded at upper and lower positions of the body 20 so that a power line is wound kept in custody thereon, a hose guide 37 that configures at least a part of the hose 29 and is made of strong materials unlike the hose 29, and a holder 38 protruded on the rear side of the body 20 so as to support the hose guide 37. The hose guide 37 is used for convenient positioning of the mini nozzle 40 when the mini nozzle is used in connection to the hose 29.

Meanwhile, to the hose guide 27, another suction nozzle unit like the mini nozzle 40 may be conveniently connected. For this purpose, one end of the hose guide 37 connected to the hose 29 is easily separated, and then another suction nozzle unit such as the mini nozzle 40 may be connected thereto. In addition, the hose 29 has a bellows shape, so its length may be shortened while being kept in custody and elongated over five times when being used by a user. Thus, the hose 29 allows a user to clean a place far away from the main body of the vacuum cleaner.

In addition, at the top of the front case 21, the hose 29 may be seated in a shrunk state, and a moving handle 27 is formed for a user to grip to carry the vacuum cleaner. The moving handle 27 may be used not only for holding and carrying the vacuum cleaner but also for holding the hose 29.

In detail, the manipulation handle 30 includes a handle 31 for a user to grip conveniently while the vacuum is operating, and an operation switch 34 formed at a predetermined position of the handle 31 and used for controlling operation of the vacuum cleaner itself such as initiation of operation of the vacuum switch and suction force of the vacuum cleaner. In addition, a length of the manipulation handle 30 may be conveniently adjusted. In more detail, for adjustment of length, the manipulation handle 30 includes an extension pipe 33 extended downward to the handle 31, and a fixed pipe 32 that supports the extension pipe 33 and allows the extension pipe 33 to be moved through it by means of selective manipulation of an extension lever 35 so that the length of the manipulation handle 30 may be shortened or elongated.

The present invention mainly has an interest on the dust collection unit 100, particularly on improved convenience in use of the dust collection unit 100. The dust collection unit 100 communicates with the body 20 to suck unfiltered air and exhaust filtered clean air toward the body 20. Hereinafter, the structure and operation of the dust collection unit will be described with reference to the accompanying drawings.

Figure 3:
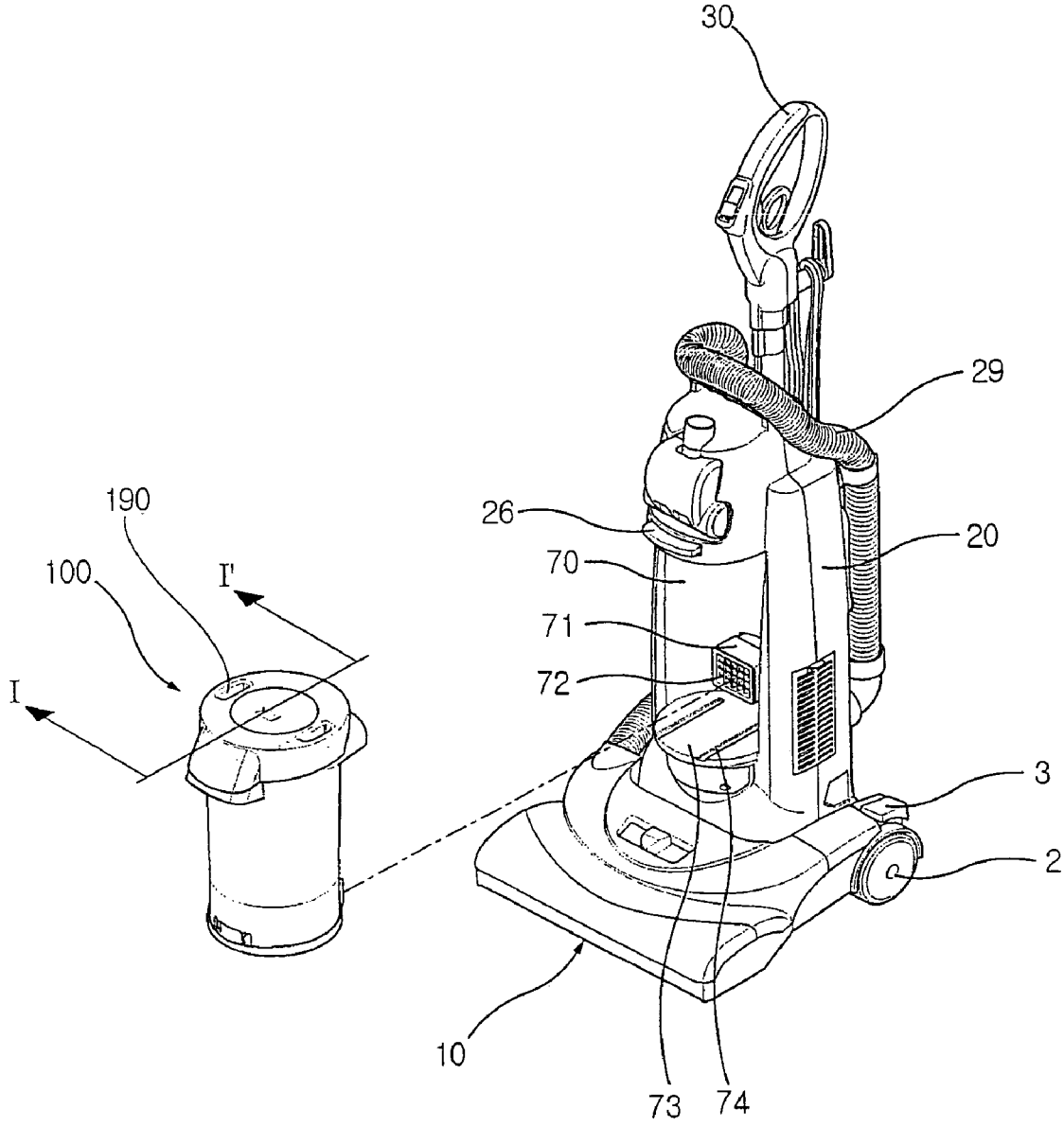
FIG. 3 is an exploded perspective view showing a state of when a dust collection unit is disassembled from a vacuum cleaner of the present invention.

FIG. 3 is an exploded perspective view showing a state of when the dust collection unit is disassembled from a vacuum cleaner of the present invention.

Referring to FIG. 3, the body 20 is provided therein with a motor (not shown) for generating a suction force and a suction fan (not shown) rotating using a power of the motor such that outer air and foreign particles are sucked through the suction nozzle unit 10. A dust collection unit seat 70 is formed at a central portion of the body 20. The dust collection unit seat 70 is concaved toward an inside of the body 20 from a front side of the body 20 such that the dust collection unit 100 is inserted into and installed at the dust collection unit seat 70.

In detail, a suction unit 71 that is an air introduction path is formed protruding from a rear surface of the dust collection unit seat 70. The suction unit 71 communicates with a discharge hole (see 165 of FIG. 6) of the dust collection unit 100. Therefore, the air introduced into the dust collection unit 100 from the body 20 is filtered at the dust collection unit 100 and then is again introduced into the inside of the body through the suction unit 71. The suction unit 71 is protruded so as to be exactly aligned with the discharge hole 165 because the discharge hole 165 of the dust collection unit 100 is concaved toward an inside of the dust collection unit 100.

A filter 72 is attached on a front surface of the suction unit 71 to filter foreign particles contained in air introduced thereinto. In particular, the filter 72 filters foreign particles which were not filtered by the dust collection unit 100 and introduced into the inside of the body 20, thereby preventing components such as a motor (not shown) built in the body 20 from being damaged. In addition, the dust collection unit seat 70 includes a pair of guide grooves 74 formed in a bottom surface 73 thereof in a front and rear direction thereof. The pair of guide grooves 74 are aligned with guide protrusions (not shown) formed at a lower surface of the dust collection unit 100 such that the dust collection unit 100 is exactly inserted into the dust collection unit seat 70. Of course, the bottom surface 73 of the dust collection unit seat 70 supports the weight of the dust collection unit 100.

The dust collection unit 100 seated on the dust collection unit seat 70 of the body 20 is shaped in a cylinder such that foreign particles are filtered by a cyclone way. The dust collection unit 100 filters foreign particles contained in the air sucked through the suction nozzle unit 10 and it is detachably assembled in the dust collection unit seat 70. The dust collection unit can collect foreign particles therein using a general cyclone way, using a separate filter, or using the cyclone and the filter at the same time.

The body 20 is further provided at a front surface thereof with the detachable lever 26. The detachable lever 26 moves up and down centering on a hinge shaft (not shown). One end of the detachable lever 26 is latched on a detachable groove (see 142 of FIG. 4) of the dust collection unit 100. Accordingly, the detachable lever 26 is used to fix an upper side of the dust collection unit 100, or is used to separate the dust collection unit 100 as a user manipulates the detachable lever 26 to release the latch between the detachable groove 142 and the dust collection unit 100.

In detail, in order to separate the dust collection unit 100, as a user pushes the detachable lever 26 with holding a handle 130 using one hand, the latch between the detachable lever 26 and the detachable groove 142 is released. Then, when the user holds the handle 130 and pulls the dust collection unit 100 outward, the dust collection unit 100 can be separated from the body 20. Therefore, it is preferable that the handle 130 is protruded outward from an upper side portion of the dust collection container 100 and a lower surface of the handle 130 is opened. In addition, it is preferable that the handle 130 is formed integrally with the dust collection container 110 for convenient fabrication thereof. Since the opened lower surface of the handle 130 enables a user to insert his or her hand from a lower side of the handle 130 to an upper side of the handle 130 and grip the handle 130, the user need not duct his/her head. In other words, since the user pushes the detachable lever 26 downward using his/her thumb of one hand and inserts fingers of the other hand from a lower direction of the handle 130 to an upper direction and extracts the handle 130, there disappears inconvenience that the user ducts his/her head so as to hold the handle 130.

Also, the handle 130 further includes a handle cover 144, which covers an upper surface of the handle 130 to make the appearance of the handle 130 better. In addition, to enable separation of the upper cover after the dust collection unit 100 is separated, the dust collection unit 100 further includes a finger groove 190 formed at a top surface of the dust collection unit 100.

Next, inner construction of the dust collection unit 100 according to the spirit of the present invention will be described in detail with reference to accompanying drawings.

Figure 4:
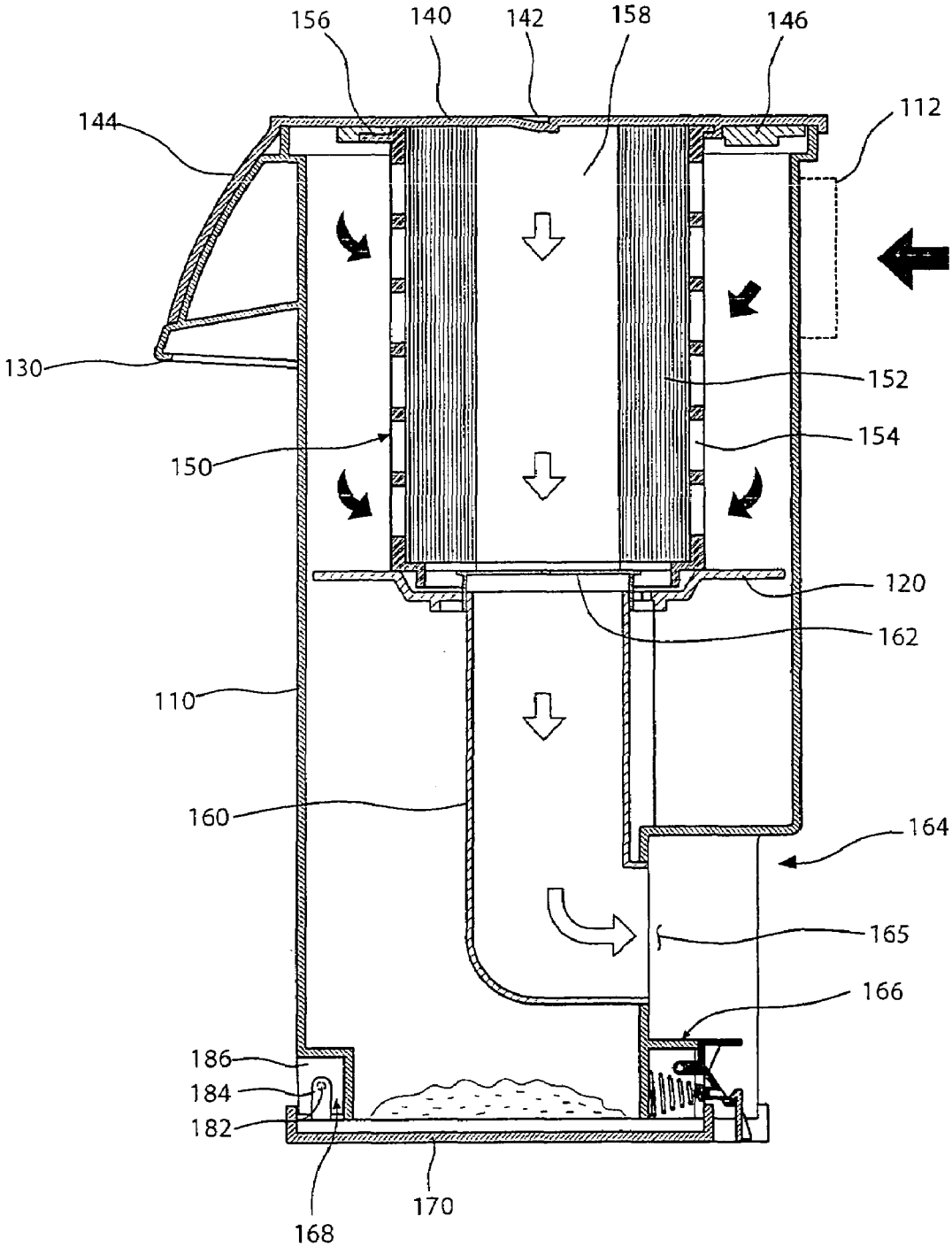
FIG. 4 is a sectional view taken along the line I-I' of FIG. 3.
Figure 5:
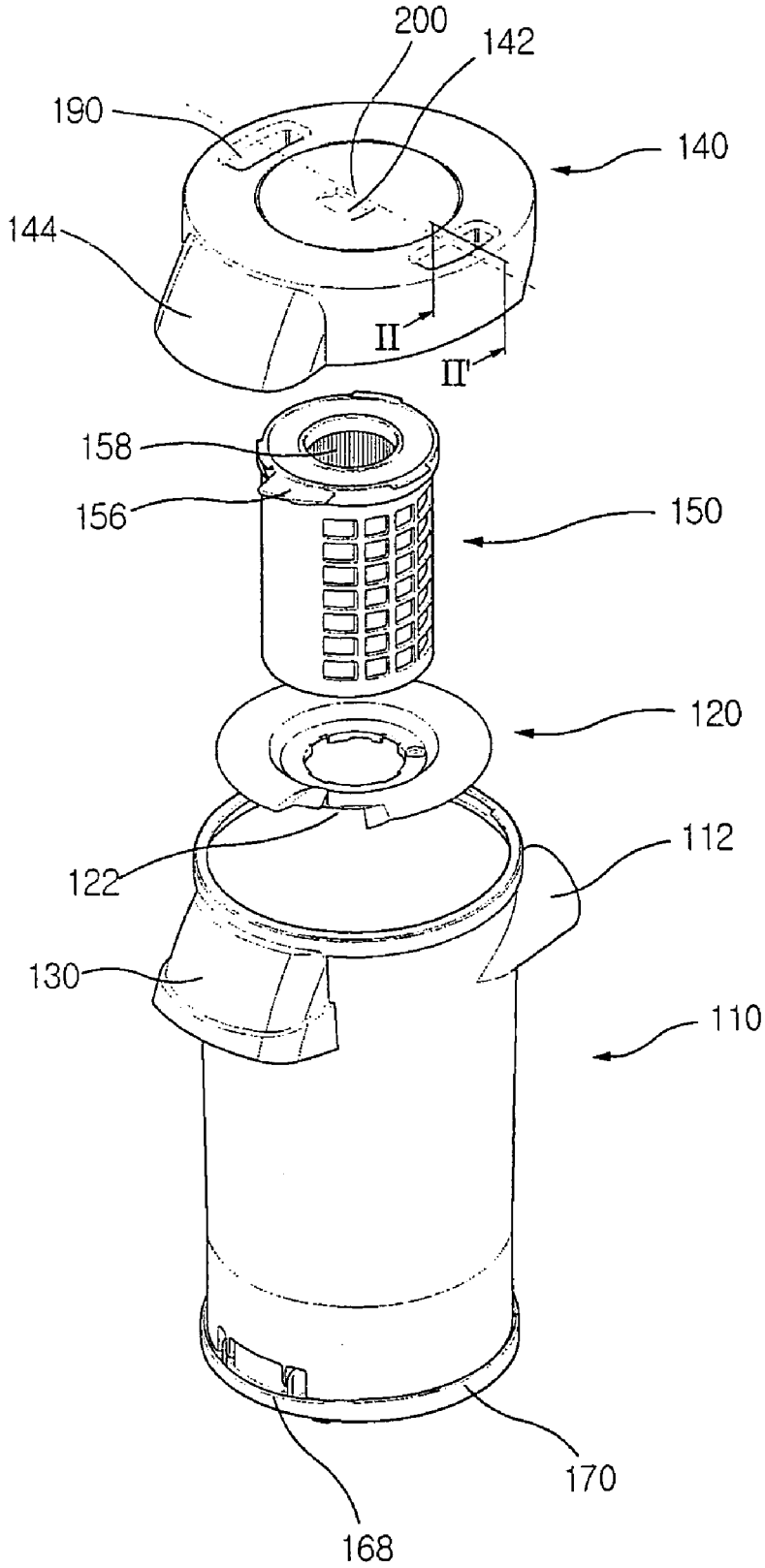
FIG. 5 is an exploded perspective view of the dust collection unit.

FIG. 4 is a sectional view taken along the line I-I' of FIG. 3 and FIG. 5 is a disassembled perspective view of the dust collection unit.

Referring to FIGS. 4 and 5, the dust collection unit 100 includes a cylindrical dust collection container 110 forming the appearance thereof. A suction guide 112 is formed at an upper side portion of the dust collection container 110. The suction guide 112 is protruded outward from the dust collection container 110 to guide the air introduced into the dust collection container 110 such that the air flows in a tangential direction along an inner wall of the dust collection container 110. Accordingly, the suction guide 112 is protruded along the tangential direction of the dust collection container 110. Also, the cylindrical shape of the dust collection container 110 is used for rotating the sucked air.

Inside the dust collection container 110, a separation plate 120 is disposed to separate foreign particles having a relatively high weight in the foreign particles contained in the introduced air at a lower side of the dust collection container 110. Inner space of the dust collection container 110 is partitioned into an upper space and a lower space by the separation plate 120. The separation plate 120 is formed having an outer diameter smaller than an inner diameter of the dust collection container 110 such that the foreign particles drop. In addition, the separation plate 120 has a communication hole 122 formed in a vertical direction to guide a downward drop of the separated foreign particles. In other words, the foreign particles contained in the air passes through the communication hole 122 of the separation plate 120 and are moved downward. Also, the separation plate 120 has a central portion concaved by a predetermined depth so as to mount a filter assembly 150 thereon.

In addition, the handle 130 is formed at the other outer circumferential surface of the suction guide 112. The handle 130 is protruded toward a lateral direction from an upper portion of the dust collection container 110 to allow a user to separate and couple the dust collection unit 100 from the body 20 with ease. Accordingly, a bottom portion of the handle 130 is opened such that a user's hand is inserted upward from an inside of the handle 130. The opened bottom surface of the handle 130 enables the user's fingers to be latched on a predetermined latch jaw and allows the user to firmly grip the dust collection unit 100.

Also, an upper surface of the dust collection container 110 is shielded by an upper cover 140. The upper cover 140 is openably and closably installed at an upper side of the dust collection container 110. The upper cover 140 has a detachable groove 142 formed downward at an upper central portion thereof. A rear end of the detachable lever 26 is latched on the detachable groove 142. The upper cover 140 also includes a handle cover 144 formed at a side portion thereof, for covering the handle 130. The handle cover 144 is formed in a shape corresponding to the appearance of the handle 130. A filter lever 146 for fixing the filter assembly 150 is disposed below the upper cover 140. The filter lever 146 is installed movably with a freedom in one direction to selectively fix a coupling rib 156 of the filter assembly 150, thereby controlling separation and coupling of the filter assembly 150.

The handle 130, which is one feature of the present invention, is formed on an outer circumferential surface of the other side of the suction guide 112. Since the lower surface of the handle 130 is opened, a user can insert his or her hand inward through the lower side of the handle 130 and firmly grip the handle 130 as the user's finger is latched on a predetermined latch jaw. Also, the handle 130 is formed at an opposite portion to the suction guide 112 such that when the user holds the handle 130, the suction guide 112 is positioned at an opposite position to the handle 130. Therefore, the handle 130 does not hinder the handling operation of the dust collection unit 100.

The upper cover 140 further includes one pair of finger grooves 190 formed at the top surface thereof. The pair of finger grooves 190 correspond to a portion concaved downward from an upper surface of the upper cover and are formed at a position symmetric to a center point 200 of the upper cover 140. In order to separate the upper cover 140 easily using one hand with gripping the handle 130 using the other hand, the pair of finger grooves 190 may be formed at a position spaced by an equal distance from a handle cover 144.

The finger grooves 190 are concaved at a predetermined depth from the upper surface of the upper cover 140. Preferably, the finger grooves 190 are formed integrally with the upper cover 140.

The filter assembly 150 is installed below the upper cover 140. The filter assembly 150 is made in the shape of a cylinder, to filter foreign particles contained in sucked air. Preferably, the filter assembly 150 is made in a dual structure so as to completely filter the foreign particles. In detail, the filter assembly includes a bellows filter 152 having a bellows repeated in a vertical direction, and a net filter 154 disposed on an outer surface of the bellows filter 152. The coupling rib 156 is protruded toward the lateral direction from the upper portion thereof. The coupling rib 156 is selectively coupled with the filter lever 146 provided in the upper cover 140. Accordingly, when the coupling rib 156 is latched on the filter lever 146, the filter assembly 150 is fixed to the upper cover 140. The filter assembly 150 is further provided at a central portion thereof with a discharge guide passage 158 formed in a vertical direction. The discharge guide passage 158 guides a downward discharge of the air that has passed through the filter assembly 150. Therefore, the air that has passed through the net filter 154 and the bellows filter 152 is guided by the discharge guide passage 158 and is moved downward.

Also, a discharge guide pipe 160 is formed along a lower central portion of the separation plate 120. The discharge guide pipe 160 has a lower end bent toward a side direction and is finally made in the form of '⊢'. The discharge guide pipe 160 guides the air discharged through the discharge guide passage 158 of the filter assembly 150 toward a lower side direction of the dust collection container 110. Accordingly, the discharge guide pipe 160 has a circular inner circumference and a top end having an inner diameter that is at least equal to or larger than an inner diameter of the discharge guide passage 158.

Also, a foreign particle shielding film 162 is disposed at an upper end of the discharge guide pipe 160. The foreign particle shielding film 162 is made of a flexible material such as rubber, and is shaped in a radially cutaway structure so as to make flow easy. The foreign particle shielding film 162 prevents the foreign particles attached on the filter assembly 150 from dropping and being introduced into the inside of the discharge guide pipe 160 when the filter assembly 150 is separated upward together with the upper cover 140. In addition, since the foreign particle shielding film 162 is made of a flexible material, it is curved downward along the airflow while the dust collection unit 100 operates and accordingly has no influence on the operation of the dust collection unit 100.

In addition, the dust collection unit has an exhaust part 164 formed at a rear side thereof. The exhaust part 164 is to guide discharge of air flowing through the discharge guide pipe 160 and it receives the protruded suction unit 71 of the body 20. In other words, the protruded suction unit 71 is protruded forward from the inner circumferential surface of the dust collection unit seat 70 of the body 20 and the exhaust part 164 is concaved forward by a predetermined portion from a rear surface of the dust collection container 110 so as to receive therein the protruded suction unit 71. The exhaust part 164 has a discharge hole 165 through which air flowing through the discharge guide pipe 160 is discharged. The discharge hole 165 is preferably formed in the shape of a rectangle to correspond to the protruded suction unit 71. Of course, it is preferable that the discharge hole 165 is exactly in contact with an end of the protruded suction unit 71 such that the air flowing therein is completely sealed.

In addition, the dust collection unit 100 further includes a lower cover 170 which is freely openable and closable. The lower cover 170 is to remove the foreign particles collected in the dust collection unit 100. The lower cover 170 is provided at a predetermined portion thereof with a hinge portion 168 such that the lower cover 170 is rotatable with respect to the dust collection container 110, and further provided at another predetermined portion thereof with a coupling portion 166 such that the lower cover 170 is fixed to the dust collection container 110. Since the coupling portion 166 is formed inside the exhaust part 164 concaved from the rear surface of the dust collection container 110, it is not observed by a user manual eye, resulting in the enhancement in the appearance. Of course, since the coupling portion 16 is received inside the dust collection container 110 so as not to be in contact with external impact, unexpected damage can be prevented. Of course, in another aspect, since the lower side of the dust collection container 110 is smaller in width than the upper side due to the existence of the exhaust part 164, the lower cover 170 has a smaller width than the upper cover 140.

The operation of the dust collection unit 100 will now be described.

Air introduced through the suction hole 112 rotates. At this time, foreign particles having a relatively large size pass through the separation plate 120 and are collected in a downward direction. Foreign particles having a relatively small size are collected in the filter assembly 150. The filtered air while passing through the filter assembly 150 passes through the discharge guide passage 158 to be guided in a downward direction and is finally discharged outside the dust collection unit 100.

Meanwhile, in order to remove the foreign particles collected on the upper surface of the lower cover-170 of the dust collection unit 100, it is required that the dust collection unit 100 be separated from the body 20 and the lower cover 170 be opened. The above operation will now be described with reference to FIGS. 2 through 5.

To separate the dust collection unit 100 from the body 20, the detachable lever 26 is pushed downward using a thumb. When the detachable lever 26 is pushed downward, the rear end of the detachable lever 26 is extracted from the detachable groove 142 of the dust collection unit 100. Accordingly, when the handle 130 of the dust collection unit 100 is gripped and pulled forward, the dust collection unit 100 is separated from the body 20. At this time, pushing the detachable lever 26 using the thumb of one hand gripping the handle 130 is to allow the user to conveniently extract the dust collection unit 100 using the other hand. At this time, the thumb of one hand applies a power pushing the detachable lever downward and other fingers of the same hand applies a power pushing the handle 130 upward. In other words, since a sum power of the thumb power and the other fingers' power is applied, the user need not duct his/her head or does not make a mistake in dealing with the dust collection unit 100.

Also, since the handle 130 is designed to have an increased width as it travels from an upper side to a lower side thereof, the handle 130 is in harmony with other components of the vacuum cleaner and is endurable against an external impact. The lower end portion of the handle 130 has an enough width so that the user's fingers can be inserted thereinto and accordingly, the user can grip the handle 130 conveniently.

After the dust collection unit 100 is separated, an operation to remove the foreign particles collected in the dust collection container 110 is performed. First, the foreign particles collected in the dust collection container 110 by a cyclone way are removed while the lower cover 170 is opened. In addition, the dirt captured by the filter assembly is removed by a separate cleaning after the upper cover 140 is removed and the filter assembly 150 is separated from the upper cover 140.

Next, the separation operation of the upper cover 140 from the dust collection unit 140 will now be described.

To extract the dust collection unit 100, the user grips the handle 130 with his/her one hand and inserts his/her thumb and forefinger into the finger grooves 190 and grips the upper cover 140 with the other hand. When the upper cover 140 is gripped by the user's fingers inserted into the fingers grooves 190, the user can separate the upper cover 140 from the dust collection container 110 by pulling the upper cover 140 upward.

Since the upper cover 140 is separated by the above operation, it can be prevented that the upper cover 140 is pushed in a predetermined direction and latched by the dust collection container 110 during the separation of the upper cover 140. In addition, since the upper cover 140 is smoothly extracted from the dust collection container 110, vibration that may be applied to the upper cover 140 can be suppressed. To this end, the worry that the foreign particles captured on the filter assembly drop is removed.

Figure 6:
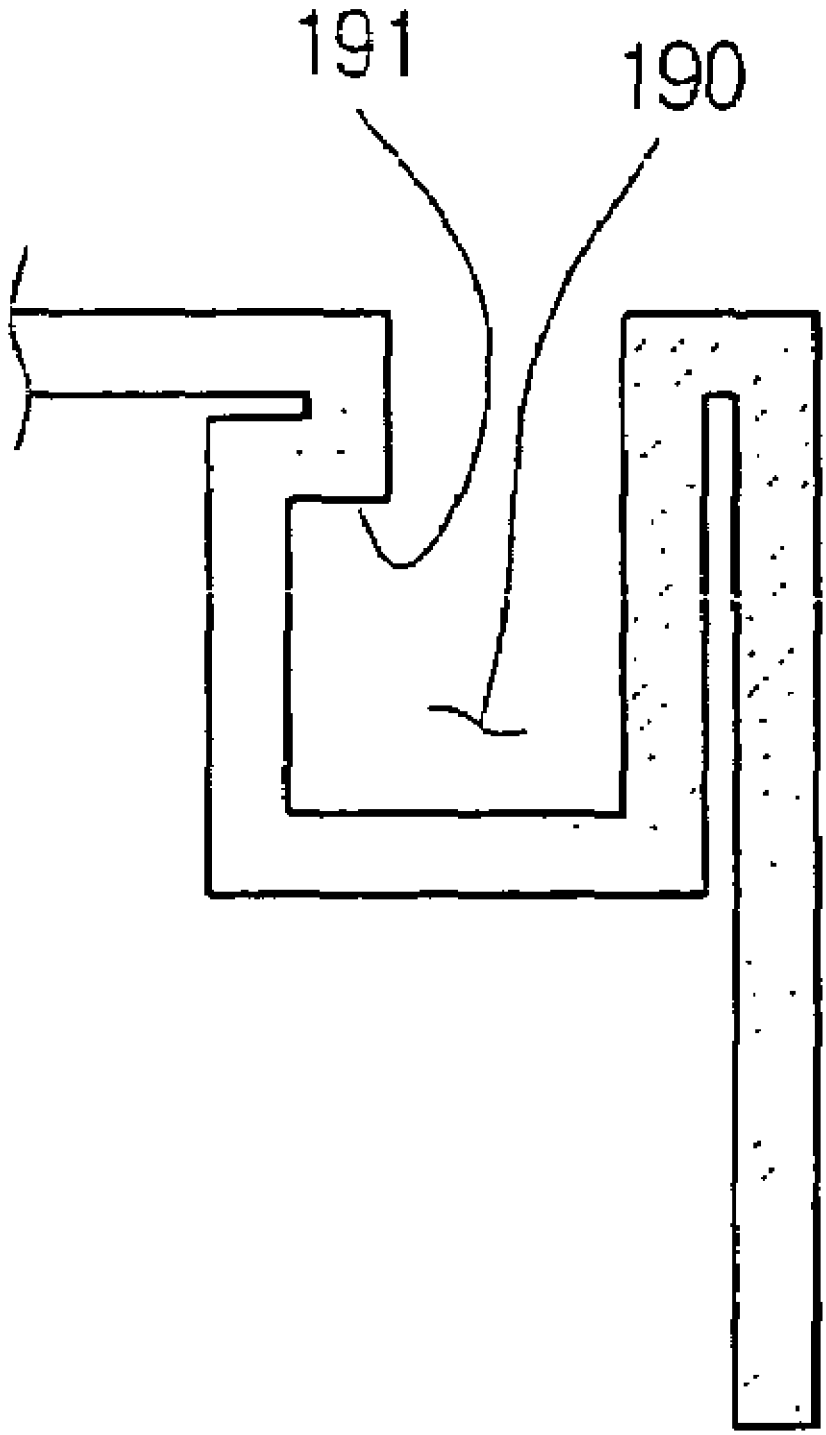
FIG. 6 is a sectional view taken along the line II-II' of FIG. 5.

FIG. 6 is a sectional view taken along the line II-II' of FIG. 5. From FIG. 6, the shape of the finger groove 190 can be understood. The finger groove 190 is concaved downward from the upper surface of the upper cover 140 and the latch jaw 191 is formed at an inner portion of the concaved finger groove 190. When the user grips the finger groove 190, the fingers are latched by the latch jaw 191. Accordingly, if the user dose not weaken the gripping force after the fingers are inserted, the user's fingers are not extracted from the finger groove 190. Of course, since the latch jaw 191 is formed toward a center of the upper cover 140, it is possible to firmly grip the upper cover 140 using a pair of fingers facing each other.

According to the present invention, the dust collection unit can be conveniently separated from the body. In other words, the dust collection unit can be handled only with one hand. In detail, the user can separate the dust collection unit in a simple way using only one hand by pushing the detachable lever downward using a thumb of his/her one hand, inserting his/her fingers into an inner upper portion of the handle to grip the handle and pulling the dust collection unit forward. Since due to the above separation operation of the dust collection unit, the user need not duct his/her head so as to grip the dust collection unit, the user can handle the dust collection unit more conveniently. Also, since the fingers' power is concentrated on a center of the palm, the worry that the dust collection unit deviates from a desired direction is removed.

In addition, in separating the upper cover from the dust collection unit, the user's convenience is improved. In detail, since the finger grooves of the upper cover are formed integrally with the upper cover and concaved inward from the upper surface of the upper cover, interference between the finger grooves and other components is excluded during the installation and separation of the dust collection unit, which makes the handling more convenient. Further, since the upper cover can be handled using a thumb and a forefinger, the handling of the upper cover is more convenient.

Furthermore, since the handle is formed integrally with the dust collection container and the finger grooves are formed integrally with the upper cover, production cost is saved and productivity is enhanced. Of course, the appearance of the dust collection unit is improved.

While the present invention has been particularly shown and described with reference to embodiments exemplified with the upright vacuum cleaner, it will be apparent to those skilled in the art that that the spirit of the present invention may be applied to the canister vacuum cleaner. Thus, it is intended that the present invention covers the modifications and variations of this invention provided they come within the scope of the appended claims and their equivalents.

What is claimed is:

1. A vacuum cleaner, comprising:

a nozzle unit for sucking outer air;

a body into which the air sucked through the nozzle unit is introduced; and a dust collection unit detachably installed in the body, wherein the dust collection unit filters out foreign particles contained in the introduced air, and wherein the dust collection unit comprises:

a cylindrical dust collection container, an upper cover that selectively opens and closes an upper surface of the dust collection container, wherein finger grooves are formed on the upper cover, the finger grooves being configured to receive a user's fingers so that the user can grasp and remove the upper cover from the cylindrical dust collection container, a handle protruded from a predetermined portion of an outer circumferential surface of the dust collection container and having an opened bottom, a separation plate disposed to separate foreign particles contained in the introduced air at a lower side of the dust collection container, and a filter assembly formed at an upper side portion of the separation plate.

2. The vacuum cleaner according to claim 1, wherein the handle extends toward a lower direction from an upper end of the dust collection container.

3. The vacuum cleaner according to claim 1, further comprising a detachment lever located adjacent the handle, wherein the detachment lever is movable downward to release the dust collection unit.

4. The vacuum cleaner according to claim 3, wherein the upper cover comprises a detachment groove that receives an end of the detachment lever.

5. The vacuum cleaner according to claim 3, wherein the detachment lever is located on the main body such that when a user's fingers are inserted into the opened bottom of the handle, the user's thumb can move the detachment lever downward to release the dust collection unit.

6. The vacuum cleaner according to claim 1, wherein the dust collection unit further comprises a suction guide formed at a portion of the dust collection container opposing the handle and through which air is sucked.

7. The vacuum cleaner according to claim 1, wherein the upper cover has a handle cover covering the handle at a predetermined portion thereof.

8. The vacuum cleaner according to claim 1, wherein the opened bottom of the handle allows a user to insert his/her fingers upward from a bottom of the handle to thereby grip the handle.

9. The vacuum cleaner according to claim 1, further comprising a detachment lever located at an upper side portion of the body adjacent to the dust collection unit, wherein the detachment lever can be manipulated by a user.

10. The vacuum cleaner according to claim 1, wherein the finger grooves are formed symmetrically about a center of the upper cover.

11. The vacuum cleaner according to claim 1, wherein the finger grooves are spaced apart from the handle at an equal distance.

12. The vacuum cleaner according to claim 1, wherein the finger grooves comprise a latch jaw formed therein.

13. A dust collection unit of a vacuum cleaner, comprising:

a dust collection container for collecting foreign particles therein, and having a handle formed on an outer circumference thereof, the handle having an opened bottom through which a user's hand is inserted;

an upper cover for selectively opening and closing an upper surface of the dust collection container, wherein a pair of finger grooves are formed on an upper surface of the upper cover such that a user can insert his/her fingers into the finger grooves to hold the upper cover when the upper cover is separated from the dust collection container;

a lower cover which is freely openable and closable to remove foreign particles collected in the dust collection container;

a separation plate disposed to separate foreign particles contained in the introduced air at a lower side of the dust collection container, and a filter assembly formed at an upper side portion of the separation plate.

14. The dust collection unit according to claim 13, wherein the upper cover comprises a handle cover covering the handle.

15. The dust collection unit according to claim 13, further comprising a filter assembly fixed to a lower surface of the upper cover, for filtering fine dust particles.

16. The dust collection unit according to claim 13, wherein the handle has an increased width as it travels toward a downward direction.

17. The dust collection unit according to claim 13, wherein the handle is spaced apart from the finger grooves at an equal distance and a suction guide for sucking outer air is formed at a portion opposing the handle.

18. A vacuum cleaner, comprising:

a nozzle unit for sucking outer air;

a body into which the air sucked through the nozzle unit is introduced;

a manipulation handle formed at an upper portion of the body and allowing a user to manipulate the body;

a connection hose connecting the nozzle unit with the body;

a dust collection unit detachably installed in the body, wherein the dust collection unit filters out foreign particles contained in the introduced air, and wherein the dust collection unit includes a cylindrical dust collection container;

a detachment lever located at an upper side portion of the body adjacent to the dust collection unit, wherein the detachment lever is manipulated when the dust collection container is separated or installed;

a handle formed on an outer circumference of the dust collection container and having an opened bottom such that a user's fingers can be inserted therein;

an upper cover that selectively opens and closes an upper surface of the dust collection container, wherein finger grooves are formed in the upper cover to enable separation of the upper cover from the dust collection container;

a separation plate disposed to separate foreign particles contained in the introduced air at a lower side of the dust collection container; and a filter assembly formed at an upper side portion of the separation plate.

* * * * *